US009914240B2

(12) United States Patent
Burgert et al.

(10) Patent No.: US 9,914,240 B2
(45) Date of Patent: Mar. 13, 2018

(54) MINERALIZED WOOD MATERIALS AND METHODS PROVIDING MINERALIZED WOOD MATERIALS

(71) Applicant: ETH Zurich, Zurich (CH)

(72) Inventors: Ingo Burgert, Seegraben (CH); Munish Chanana, Bayreuth (DE); Vivian Merk, Zurich (CH)

(73) Assignees: ETH ZURICH, Zurich (CH); SWISS FEDERAL AL LABORATORIES FOR MATERIALS SCIENCE AND TECHNOLOGY (EMPA), Dubendorf (CH)

( * ) Notice: Subject to any disclaimer, the term of this patent is extended or adjusted under 35 U.S.C. 154(b) by 0 days.

(21) Appl. No.: 15/306,087

(22) PCT Filed: Apr. 17, 2015

(86) PCT No.: PCT/EP2015/058374
§ 371 (c)(1),
(2) Date: Oct. 22, 2016

(87) PCT Pub. No.: WO2015/162061
PCT Pub. Date: Oct. 29, 2015

(65) Prior Publication Data

US 2017/0043497 A1 Feb. 16, 2017

(30) Foreign Application Priority Data

Apr. 24, 2014 (EP) ..... 14001462

(51) Int. Cl.

| | |
|---|---|
| ***B27K 3/32*** | (2006.01) |
| ***B27K 3/02*** | (2006.01) |
| ***B27K 3/18*** | (2006.01) |
| ***B27K 3/08*** | (2006.01) |

(52) U.S. Cl.
CPC ..... *B27K 3/32* (2013.01); *B27K 3/0292* (2013.01); *B27K 3/08* (2013.01); *B27K 3/18* (2013.01); *B27K 2240/30* (2013.01)

(58) Field of Classification Search
CPC ..... B27K 3/32; B27K 3/0292; B27K 3/08; B27K 3/18; B27K 2240/30
USPC ..... 428/541
See application file for complete search history.

(56) References Cited

U.S. PATENT DOCUMENTS

2002/0110677 A1* 8/2002 Raczek ..... A01N 37/06
428/292.4

FOREIGN PATENT DOCUMENTS

CN 101797762 * 1/2012

* cited by examiner

*Primary Examiner* — Leszek Kiliman
(74) *Attorney, Agent, or Firm* — JMB Davis Ben-David

(57) ABSTRACT

The invention relates to a mineralized wood material comprising at least one metal salt MA in the lumina of the mineralized wood material, in particular in the lumina and the cell walls of the mineralized wood material and methods for providing said mineralized wood material.

14 Claims, 7 Drawing Sheets

Figure 7:
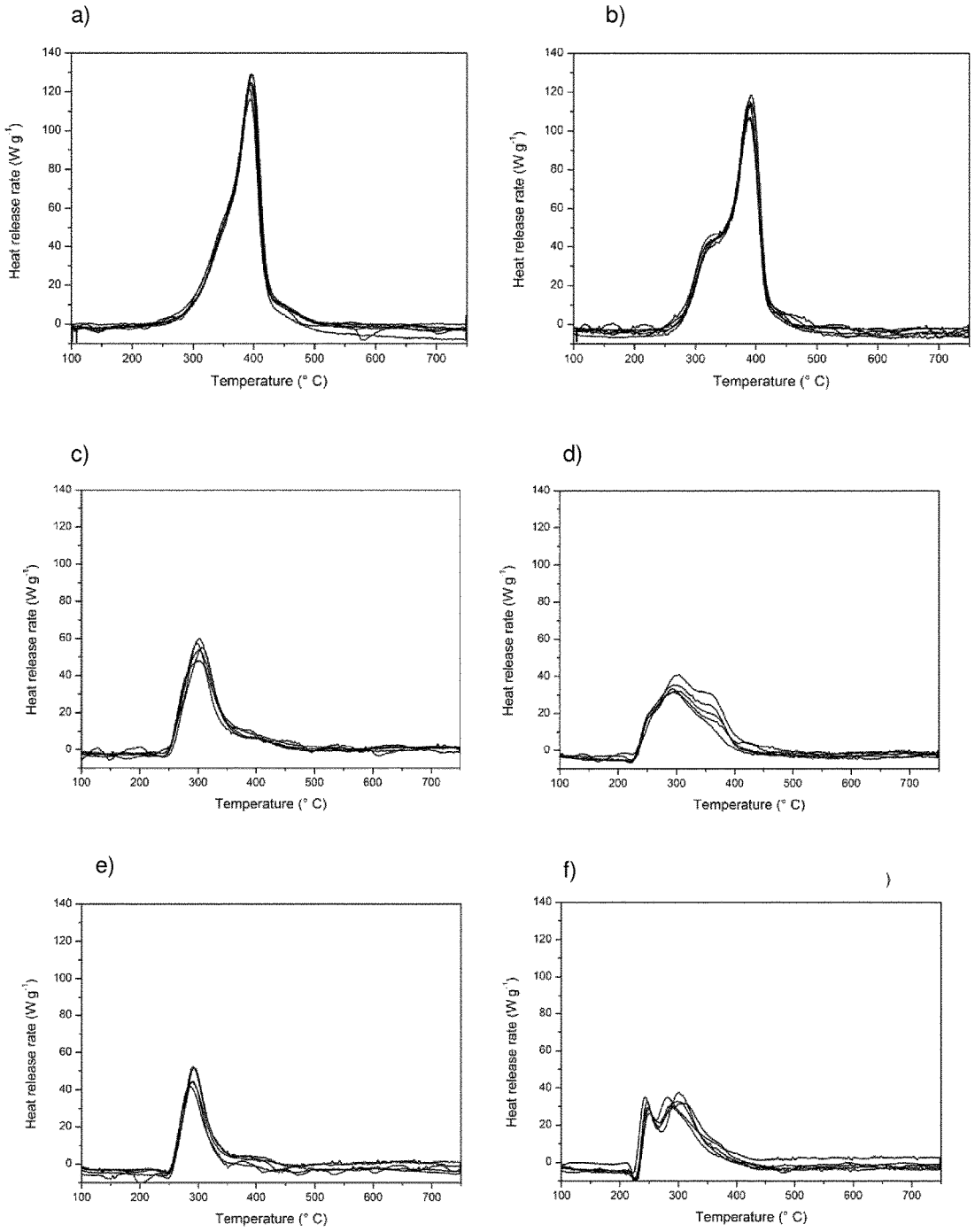

Fig. 7 (continuation)
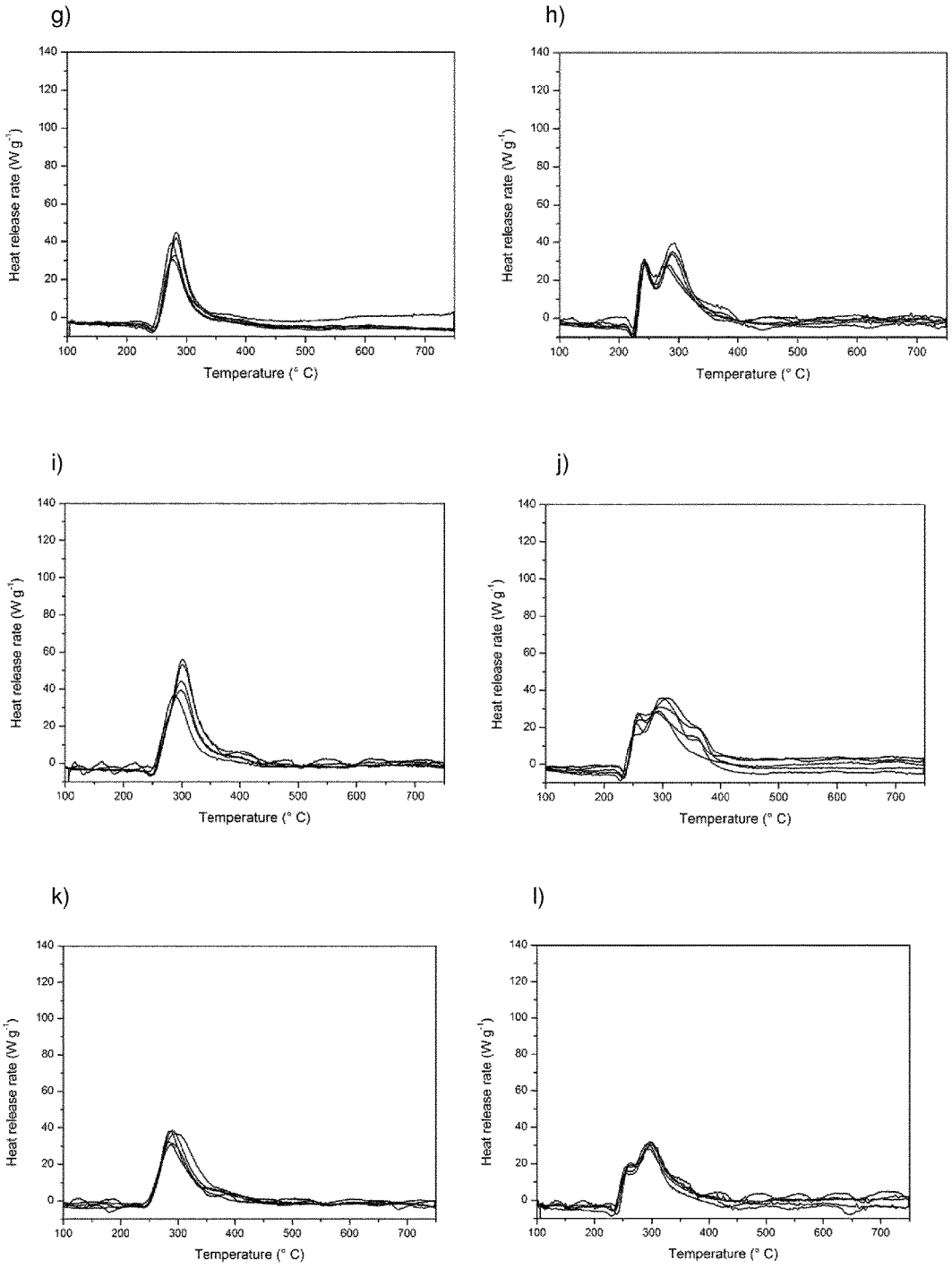

MINERALIZED WOOD MATERIALS AND METHODS PROVIDING MINERALIZED WOOD MATERIALS

CROSS-REFERENCE TO RELATED APPLICATIONS

This is the U.S. National Stage of International Application No. PCT/EP2015/058374, filed Apr. 17, 2015, which was published in English under PCT Article 21(2), and which in turn claims the benefit of European Patent Application No. 14001462.2 filed on Apr. 24, 2014.

FIELD OF THE INVENTION

The invention relates to mineralized wood materials and methods providing said mineralized wood materials.

BACKGROUND OF THE INVENTION

The flammability of wood is a major challenge for the application of wood-based products, in particular for use in construction or the production of furniture. Therefore, various approaches for improving the fire retardancy of wood have been proposed so far, for instance the addition of fire-retardant substances, the chemical modification with conventional fire-retardants, the development of wood-inorganic composites or the deposition of flame retardant coatings. Fire-retardant agents can be incorporated by spraying, dipping, brushing, immersing or pressure-impregnation. Phosphorous- or nitrogen-containing compounds based on urea or melamine show flame-resistant potential and also boron-based compounds have been employed in fire-retardant systems, for instance mixtures of $ZrO_2$-$B_2O_3$, boric acid and borax in a melamine formaldehyde resin or borates combined with a varnish coating. Halogen-compounds offer fire-retardant features through free-radical quenching and extended char formation. Wood-inorganic composites based on silica or titania can be incorporated through sol-gel reactions. Further, complexes of silic and boric acid or nano-silver have been investigated in view of fire retardancy. However, these treatments also entail drawbacks such as a reduced mechanical performance of timber products or the release of leachable or volatile, toxic compounds causing environmental hazards.

A major drawback is the precipitation of salts at the wood surface which can impede a solid wood treatment.

The objective of the present invention is to provide a novel, cost-efficient and simple industrial modification process of wood mineralization to produce mineralized wood material with improved properties, in particular an improved fire retardancy. The object of the invention is further to provide novel, mineralized wood materials with improved properties, in particular an improved fire retardancy. This objective is attained by the subject matter of the independent claims.

TERMS AND DEFINITIONS

As used herein, the following terms have the designated definitions, unless the context clearly indicates otherwise.

As used herein the term "salt" refers to ionic compounds comprising a cationic and an anionic moiety. For example the salt YA may comprise a cationic moiety, such as $Li^+$, $Na^+$, $K^+$, $H^+$ or $NH_4^+$, and an anionic moiety, such as $F^-$, $SO_4^{2-}$ or $CO_3^{2-}$. Thus, YA may be NaF, $Na_2SO_4$ or $(NH_4)_2CO_3$.

As used herein the term "salt solution" refers to a solution of the salt YA comprising a cationic and an anionic moiety. For example a solution of the salt YA may comprise a cationic moiety, such as $Li^+$, $Na^+$, $K^+$, $H^+$ or $NH_4^+$, and an anionic moiety, such as $F^-$, $SO_4^{2-}$ or $CO_3^{2-}$. Thus, YA may be NaF, $Na_2SO_4$ or $(NH_4)_2CO_3$. Thus, a salt solution may comprise a cationic metal moiety such as $Li^+$, $Na^+$ or $K^+$ or a non-metal moiety, such as $H^+$ or $NH_4^+$, and an anionic counterpart.

As used herein the term "metal salt" refers to ionic compounds comprising a monovalent or multivalent cationic metal moiety and an monovalent or multivalent anionic moiety. For example the salt MX may comprise a cationic metal moiety from groups 2-15, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$ and an anionic moiety, such as $Cl^-$, $Br^-$ or $NO_3^-$, and the salt MA may comprise a cationic metal moiety from groups 2-15, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, and an anionic moiety, such as $HSO_4^-$, $SO_4^{2-}$, $HPO_4^-$, $H_2PO_4^{2-}$, $PO_4^{3-}$, $HCO_3^-$ or $CO_3^{2-}$, $BO_3^{3-}$, $C_2O_4^{2-}$, $\{[SiO_3]^{2-}\}_n$ or $S^{2-}$. Thus, MX may be $CaBr_2$ or $MgCl_2$ and MA may be $CaSO_4$ or $MgCO_3$.

As used herein the term "metal salt solution" refers to a solution of the metal salt MX compounds comprising a monovalent or multivalent cationic metal moiety and an monovalent or multivalent anionic moiety. For example a solution of the metal salt MX may comprise a cationic metal moiety from groups 2-15, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$ and an anionic moiety, such as $Cl^-$, $Br^-$ or $NO_3^-$.

The ionic compounds referred to as "salts" or "metal salts" may also comprise more than one cationic or anionic moiety (double salts), such as alstonite ($BaCa(CO_3)_2$) or dolomite $CaMg(CO_3)_2$.

As used herein the term "wood material" refers to any material comprising wood as an essential part, in particular solid wood products, wood-containing base materials, wood-based materials, semi-finished products or components.

As used herein the term "unmineralized wood material" refers to a wood material before any impregnation steps are applied.

As used herein the term "solid wood products" refers to timber products, which consist basically of solid wood or solid wood parts. Solid wood describes wood-containing base materials, whose profiles are carved out from a tree trunk and are potentially processed further by cutting/machining, without changing the texture of the wood. Solid wood products can be used to produce components, semi-finished products or products.

As used herein the term "wood-containing base materials" refers to all wood-containing materials, which can be used as base materials for the production of wood-based material, components, semi-finished products, products or solid wood products. Wood-containing base materials can include wooden particles or wood pieces, for instance, which are used in the production of chipboards, oriented strand boards or other wood-based materials. Wood-containing base materials are especially used in the production of wood-based materials.

As used herein the term "wood-based materials" refers to a material, which is re-assembled and consists of fibres, particles, or layers of wood of different shape, size and thicknesses. The particles can, for example, comprise wood strips, wood chips or wood fibers of the same or of different types of wood, of a certain size or of different sizes.

As used herein the term "semi-finished products" refers to base material products, for instance a plate, a pole or a tube, which can be processed further to the actual finished product (the final product). A semi-finished product can include an appropriately cut piece of solid-wood or comprise different wood-containing base materials. According to the invention, a semi-finished product can also be wood chips or wood stripes.

As used herein the term "components" refers to a part (for instance a solid wood product, a wood-containing base material and/or a wood-based material) of a larger complex. A complex can be a building or a storage product, like a showcase, or a part of furniture. The components (in particular different components) can form the complex together, given an appropriate composition.

SUMMARY OF THE INVENTION

According to a first aspect of the invention, the invention relates to a mineralized wood material comprising at least one metal salt of the formula MA in the mineralized wood material, in particular in the cell lumina and the cell walls of the mineralized wood material.

According to a second aspect of the invention, the invention relates to a method for treatment of a wood material comprising the steps of:

a) provision of a metal salt solution comprising at least one metal salt of the formula MX dissolved in a solvent and a salt solution comprising at least one salt of the formula YA dissolved in another solvent, b) treatment of said wood material by
   an impregnation cycle comprising a first impregnation step using one of said solutions and a subsequent second impregnation step using the other one of said solutions, or
   a diffusion step comprising a diffusion of the metal salt solution from one side and a diffusion of the salt solution from the other side into the wood material, providing a precipitation of a metal salt of the formula MA inside the wood material, wherein the solvents of the metal salt solution and the salt solution are characterized in that the metal salt MA has a low or almost no solubility in said solvents.

According to a third aspect of the invention, the invention relates to a method for treatment of a wood material comprising the steps of:

a) provision of a solution comprising at least one metal salt of the formula MX dissolved in dialkylcarbonate, such as dimethyl carbonate or diethyl carbonate, b) impregnation of a wood material with at least one impregnation step using said solution, c) hydrolysis of the impregnated wood with an aqueous solution, in particular with an aqueous solution comprising a pH range of more than 7, providing a metal carbonate derived from the metal salt MX inside the wood material.

According to a fourth aspect of the invention, the invention relates to a mineralized wood material comprising at least one metal salt of the formula MA in the mineralized wood, in particular in the lumina and the cell walls of the mineralized wood, obtained by a method according the second aspect of the invention or by a method according to the third aspect of the invention.

DETAILED DESCRIPTION OF THE INVENTION

The first aspect of the invention relates to a mineralized wood material comprising at least one metal salt of the formula MA (e.g. one metal salt MA or a mixture of different metal salts MA) in the mineralized wood material, in particular in the cell lumina and the cell walls of the mineralized wood material.

The mineralized wood material according to the first aspect of the invention may comprise one metal salt, such as $CaCO_3$, several different metal salts, such as $CaCO_3$ and $BaCO_3$ or $CaCO_3$ and $BaSO_4$, and/or one or more double salts, such as $BaCa(CO_3)_2$, inside the wood material.

To improve wood properties (e.g. durability, dimensional stability, mechanical properties) usually the wood cell wall should be affected by the modification treatments, because the wood cell wall is the part of the wood in which the wood material is agglomerated. However, the accessibility of the cell wall is restricted due to a complex organization of the wood polymers and its nanoporous structure. In terms of the wood mineralization for improvement of flame retardancy both, in-situ precipitation in the cell wall and in the cell lumina is effective, but cell wall filling is essential to directly protect the organic and flammable wood material.

In some embodiments, the mineralized wood comprises at least one metal salt MA with a weight in the range of 5 wt % to 40 wt % with respect to the weight of the unmineralized wood material.

The higher the mineral content, the better the improvement in flame retardancy. The amount of salt in the wood structure can be tuned for different wood species as a function of concentration, treatment cycles, duration of each cycle, wood product dimensions.

In some embodiments, the metal salt MA has a solubility below 0.01 g per 100 mL solvent.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$.

In some embodiments, M is selected from $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$.

In some embodiments, M is selected from earth alkali metals, in particular from magnesium, barium or calcium, more particularly from calcium.

In some embodiments, A is selected from organic or inorganic compounds, such as sulfate, carbonate, borate, aluminate, silicate, oxalate, citrate, malate, fluoride or phosphate, in particular selected from (partially) deprotonated acids (e. g. phosphate, carbonate, sulfate, borate, aluminate, silicate, oxalate, citrate, malate or fluoride), with the exception of HCl, HBr or HI.

In some embodiments, A is selected from inorganic compounds, in particular from sulfate, carbonate, borate, fluoride or phosphate.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$ and A is selected from organic or inorganic compounds, such as sulfate, carbonate, aluminate, silicate, borate, oxalate, citrate, malate, fluoride or phosphate, in particular A is selected from inorganic compounds, in particular from sulfate, carbonate, borate, fluoride or phosphate.

In some embodiments, M is selected from metals (in particular earth alkali metal) and A is an anion selected from (partially) deprotonated acids (e. g. phosphate, carbonate, sulfate, borate, aluminate, silicate, oxalate, citrate, malate or fluoride), with the exception of the acids HCL, HBr or HI, in particular A is selected from sulfate, carbonate, borate, fluoride or phosphate.

The mineralized wood according to the first aspect of the invention comprises due to the at least one metal salt MA in the wood structure—a delayed ignition of the wood material, a slower flame spread across the wooden surface and a reduction in the energy release rate. Thus, a possible fire process is slowed down significantly.

The wood material may also comprise—aside from the fire protection aspect—further improved properties due to the applied metal salts. A general user can choose—based on his knowledge—the necessary metal salts in order to improve the properties further. Non limiting examples are given below.

In some embodiments, MA is $BaSO_4$ and the mineralized wood material comprises improved acid and base resistance.

In some embodiments, MA is $BaCO_3$ and the mineralized wood material comprises biocidal effect.

In some embodiments, MA is $SrCO_3$ or $BaSO_4$ and the mineralized wood material comprises X-ray absorbing properties.

In some embodiments, MA is $CaCO_3$ or $BaSO_4$ and due to its high density the mineralized wood material comprises acoustic insulation properties and enhanced mechanical properties (e.g. hardness, compressive strength) for construction purposes.

In some embodiments, MA is ZnS and the mineralized wood material can offer stability to UV light or luminescent properties.

The second aspect of the invention relates to a method for treatment of a wood material comprising the steps of:

a) provision of a metal salt solution comprising at least one metal salt of the formula MX dissolved in a solvent and a salt solution comprising at least one salt of the formula YA dissolved in another solvent, b) treatment of said wood material by an impregnation cycle comprising a first impregnation step using one of said solutions and a subsequent second impregnation step using the other one of said solutions, or a diffusion step comprising a diffusion of the metal salt solution from one side and a diffusion of the salt solution from the other side into the wood material, providing a precipitation of a metal salt of the formula MA inside the wood material, wherein the solvents of the metal salt solution and the salt solution are characterized in that the metal salt MA has a low or almost no solubility in said solvents, in particular the metal salt MA has a solubility below 0.01 g per 100 mL in said solvents.

In other words, the metal salt MA has a low solubility product ($K_{sp}$) in both solvents (the solvent of the metal salt solutions and the solvent of the salt solution).

For example, the metal salt MA has a low solubility product in both solvents, such as $K_{sp}$ (calcite, 25° C.)=$3.31\cdot10^{-9}$ $mol^2\ L^{-2}$, $K_{sp}$ (amorphous calcium carbonate, 25° C.)=$3.98\cdot10^{-7}$ $mol^2\ L^{-2}$, $K_{sp}$ (vaterite, 25° C.)=$1.23\cdot10^{-8}$ $mol^2\ L^{-2}$, $K_{sp}$ (aragonite, 25° C.)=$4.57\cdot10^{-9}$ $mol^2\ L^{-2}$ [see Gal, J.-Y.; Bollinger, J.-C.; Tolosa, H.; Gache, N., Calcium carbonate solubility: a reappraisal of scale formation and inhibition. Talanta 1996, 43 (9)], than the precursor salts MX and YA.

Herein, we define the solubility of the salts MX, YA or MA for ≤0.01 g/100 mL of a solvent as poor, ≤0.1 g/100 mL of a solvent as fair, ≤1 g/100 mL of a solvent as good and ≥10 g/100 mL of a solvent as excellent (see also table 1).

TABLE 1

Exemplary solubility data according to the literature [see Haynes, W. M., CRC Handbook of Chemistry and Physics. 94rd ed. ed.; Taylor & Francis New York, 2013].

| Chemical compound | Aqueous solubility (g/100 mL $H_2O$) Qualitative solubility in other solvents |
|---|---|
| $CaCl_2$ (anhydrous, monohydrate, dihydrate, tetrahydrate, hexahydrate) | 81.3; soluble in ethanol |
| $Na_2CO_3$ (anhydrous, monhydrate, decahydrate) | 30.7, insoluble in ethanol |
| $CaCO_3$ (aragonite, calcite) | 0.00066; insoluble in ethanol |
| $CaCO_3$ (vaterite) | 0.0011; insoluble in ethanol |

In some embodiments, the method for treatment of a wood material comprises the steps of:

a) provision of a metal salt solution comprising at least one metal salt of the formula MX dissolved in a solvent and a salt solution comprising at least one salt of the formula YA dissolved in another solvent, and b) treatment of said wood material by a diffusion step comprising a diffusion of the metal salt solution from one side and a diffusion of the salt solution from the other side into the wood material, providing a precipitation of a metal salt of the formula MA inside the wood material, wherein the solvents of the metal salt solution and the salt solution are characterized in that the metal salt MA has a low or almost no solubility in said solvents, in particular the metal salt MA has a solubility below 0.01 g per 100 mL in said solvents.

The metal cation M of the desired product MA is provided by a different solution than the anionic counterpart A (which is dissolved in the other solution). The metal part M and the anionic counterpart A are completely solved in the respective solvents. Both parts (M and A) are introduced by a diffusion in the wood material from opposite sides. This allows for a provision of the metal part M (and the anionic counterpart A) not only on the surface of the processed wood but deep inside the wood material. By applying the two-side diffusion step the metal part M and the anionic counterpart A can be brought into contact with the respective counterpart A (or M) "deep inside" the wood material. By choosing the solvents of metal salt solution and the salt solution in such a way that the solubility of the desired salt MA is below 0.01 g per 100 mL in the respective solvents, the desired metal salt MA precipitates in-situ inside the wood material.

Thus, the processed mineralized wood comprises a high fire retardancy due to the precipitated salts MA "deep inside" the wood material.

This simple diffusion-controlled method allows for in situ mineralization of wood materials and promotes slow crystallization of the product MA far from the surface of the processed wood material. Hence, this mineralization process does not necessarily require vacuum, pressure or stirring systems. It is particularly suitable for the modification of veneers and boards with large area or for the operation of several sealed reaction chambers in series.

In some embodiments, the method for treatment of a wood material comprises the steps of:

a) provision of a metal salt solution comprising at least one metal salt of the formula MX dissolved in a solvent and a salt solution comprising at least one salt of the formula YA dissolved in another solvent, b) treatment of said wood material by an impregnation cycle comprising a first impregnation step using one of said solutions and a subsequent second impregnation step using the other one of said solutions, providing a precipitation of a metal salt of the formula MA inside the wood material, wherein the solvents of the metal salt solution and the salt solution are characterized in that the metal salt MA has a low or almost no solubility in said solvents, in particular .the metal salt MA has a solubility below 0.01 g per 100 mL in said solvents.

The precursors (MX and YA) are dissolved in different solvents (solvents of the metal salt and the salt solution) and the solutions are applied subsequently on the wood material in two impregnation steps (one impregnation cycle). Thus, the first impregnation step may comprises an impregnation with the metal salt solution, wherein the second impregnation step may comprise the impregnation with the salt solution. In an alternative route, the first impregnation step may comprise an impregnation with the salt solution, wherein the second impregnation step may comprise the impregnation with the metal salt solution.

In other words, the metal cation M of the desired product MA is provided by a different solution and at a different stage than the anionic counterpart A (which is dissolved in the other solution). The metal part M (or the anionic counterpart A of the metal salt MA—if an alternative impregnation route is chosen) is completely solved in the applied solvent of the first impregnation step. This allows for a provision of the metal part M (or the anionic counterpart A) not only on the surface of the processed wood but allows also for a deep penetration of the wood material. By applying the second impregnation step using the other solution comprising the anionic counterpart A (or the metal part M), the metal part M (or the anionic counterpart A) can be brought into contact with the respective counterpart A (or M) "deep inside" the wood material. By choosing the solvent of the second impregnation step in such a way that the solubility of the desired salt MA is below 0.01 g per 100 mL in the respective (applied) solvents (in other words badly soluble in the solvent of the first and second impregnation step), the desired metal salt MA precipitates. Since the metal part M and the counter-anion A are distributed throughout different layers of the wood (deep penetration), the metal salt MA not only precipitates at (or near) the surface but also "deep inside" the processed wood (in the wood lumina and even in the cell walls). Thus, the processed mineralized wood material according to the method of the invention comprises a high fire retardancy due to the precipitated salts MA "deep inside" the wood material.

In some embodiments, the metal salt solution comprises several (e.g. two metal salts MX, such as $CaCl_2$ and $BaCl_2$ or $CaCl_2$ and $BaBr_2$) metal salts of the formula MX dissolved in solvent and the salt solution comprises one salt of the formula YA (such as $Na_2CO_3$, $(NH_4)_2CO_3$ or $K_2CO_3$) dissolved in another solvent.

In some embodiments, the metal salt solution comprises several (e.g. two metal salts MX, such as $CaCl_2$ and $BaCl_2$ or $CaCl_2$ and $BaBr_2$) metal salts of the formula MX dissolved in a solvent and the salt solution comprises several salts of the formula YA (such as $Na_2CO_3$ and $Na_2SO_4$ or $K_2CO_3$ and $Na_2SO_4$) dissolved in another solvent.

Other combinations with different salts or metal salts are possible.

In some embodiments, in said first impregnation step said salt solution is used and in said subsequent second impregnation step said metal salt solution is used, providing a metal salt of the formula MA.

In some embodiments, in said first impregnation step said metal salt solution is used and in said subsequent second impregnation step said salt solution is used, providing a metal salt of the formula MA.

The solvents of the metal salt and salt solution are characterized in that the metal salt MA has a solubility below 0.01 g per 100 mL in said solvents. In other words, the metal M of the metal salt MX and the anionic counterpart A of the salt YA are chosen in such a way that the desired product MA comprises the above mentioned solubility (badly to nearly insoluble in the applied solvents).

In some embodiments, the solvents of the metal salt and salt solution are characterized in that the metal salt MA has a solubility below 0.01 g per 100 mL in said solvents and the metal salt MX (dissolved in the solvent of the metal salt solution) has a solubility below 0.01 g per 100 mL in said solvent of the metal salt solution, wherein the salt YA comprises a good solubility in the solvents of the metal salt and salt solution.

In some embodiments, the solvents of the metal salt and salt solution are characterized in that the metal salt MA has a solubility below 0.01 g per 100 mL in said solvents and the salt YA (dissolved in the solvent of the salt solution) has a solubility below 0.01 g per 100 mL in said solvent of the salt solution, wherein the metal salt MX comprises a good or intermediate solubility above 0.1 g/100 mL in the solvents of the metal salt and salt solution.

In other words, at least one precursor is badly soluble in the other applied solution, wherein the other one of the educts (precursor) comprises a good or intermediate solubility above 0.1 g/100 mL in both applied solvents.

The insolubility of YA or MX in one of the solvents prevents a leaching of the salt incorporated in a previous impregnation step by the respective solvent. For instance, YA=$Na_2CO_3$ in water is impregnated in the first step. In the second step, MX=$CaCl_2$ in ethanol is used. $Na_2CO_3$ is poorly soluble in ethanol. The product MA=$CaCO_3$ is poorly soluble in ethanol and water.

This method is versatile with respect to the incorporated product MA and fosters a quantitative formation of MA due to reduced ion leaching.

Dependent on the desired product and the applied wood material a general expert can chose the preferred process.

In some embodiments, the solvents of the metal salt and the salt solution have diverging polarity, e. g. water and ethanol, methanol and isopropanol, dimethylformamide and hexane.

A general user may choose the necessary salts based on his general knowledge or base literature concerning the solubility of salts [see Haynes, W. M., CRC Handbook of Chemistry and Physics. 94rd ed. ed.; Taylor & Francis New York, 2013].

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$.

In some embodiments, M is selected from multivalent metals, such as $Ca^{2+}$, $Ba^{2+}$, $Mg^{2+}$ or $Al^{3+}$.

In some embodiments, M is selected from earth alkali metals, in particular from magnesium, barium or calcium, more particularly from calcium.

In some embodiments, A is selected from organic or inorganic compounds, such as sulfate, carbonate, borate, aluminate, silicate, oxalate, citrate, malate, fluoride or phosphate, in particular selected from (partially) deprotonated acids (e. g. phosphate, carbonate, sulfate, borate, aluminate, silicate, oxalate, citrate, malate or fluoride), with the exception of HCl, HBr or HI.

In some embodiments, A is selected from organic or inorganic compounds, such as sulfate, carbonate, borate, oxalate, fluoride or phosphate.

In some embodiments, A is selected from inorganic compounds, in particular from sulfate, carbonate, borate, fluoride or phosphate.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$, and A is selected from organic or inorganic compounds, such as sulfate, carbonate, borate, aluminate, silicate, oxalate, citrate, malate, fluoride or phosphate, in particular selected from (partially) deprotonated acids (e. g. phosphate, carbonate, sulfate, borate, aluminate, silicate, oxalate, citrate, malate or fluoride), with the exception of HCl, HBr or HI.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$, and A is selected from organic or inorganic compounds, such as sulfate, carbonate, borate, oxalate, fluoride or phosphate, in particular A is selected from inorganic compounds, in particular from sulfate, carbonate, borate, fluoride or phosphate.

In some embodiments, M is selected from earth alkali metals, in particular from magnesium, barium or calcium, more particularly from calcium, and A is selected from organic or inorganic compounds, such as sulfate, carbonate, borate, oxalate, fluoride or phosphate, in particular A is selected from inorganic compounds, in particular from sulfate, carbonate, borate, fluoride or phosphate.

In some embodiments, Y is selected from monovalent compounds, such as $Na^+$, $K^+$, $H^+$, or $NH_4^+$.

In some embodiments, Y is selected from alkali metals or $NH_4^+$.

In some embodiments, Y is selected from alkali metals, in particular from sodium or potassium.

In some embodiments, X is selected from nitrate, bromide, iodide or chloride, in particular from bromide, iodide or chloride, more particularly X is chloride.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$, A is selected from organic or inorganic compounds, such as sulfate, carbonate, borate, aluminate, silicate, oxalate, citrate, malate, fluoride or phosphate, in particular selected from (partially) deprotonated acids (e. g. phosphate, carbonate, sulfate, borate, aluminate, silicate, oxalate, citrate, malate or fluoride), with the exception of HCl, HBr or HI, Y is selected from monovalent compounds, such as $Na^+$, $K^+$ or $NH_4^+$, in particular from alkali metals or $NH_4^+$, and X is selected from bromide, iodide or chloride, in particular X is chloride.

In some embodiments, M is selected from multivalent metals, such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$, and A is selected from organic or inorganic compounds, such as sulfate, carbonate, borate, oxalate, fluoride or phosphate, in particular A is selected from inorganic compounds, in particular from sulfate, carbonate, borate, fluoride or phosphate, Y is selected from monovalent compounds, such as $Na^+$, $K^+$ or $NH_4^+$, in particular from alkali metals or $NH_4^+$, and X is selected from bromide, iodide or chloride, in particular X is chloride.

In some embodiments, M is selected from earth alkali metals, in particular from magnesium, barium or calcium, more particularly from calcium, and A is selected from organic or inorganic compounds, such as sulfate, carbonate, borate, oxalate, fluoride or phosphate, in particular A is selected from inorganic compounds, in particular from sulfate, carbonate, borate, fluoride or phosphate, Y is selected from alkali metals, in particular from sodium or potassium and X is selected from bromide, iodide or chloride, in particular X is chloride.

In some embodiments, M is calcium, Y is sodium, A is carbonate and X is selected from chloride, bromide or iodide. In other words, MX is $CaCl_2$, $CaBr_2$ or $CaI_2$ and YA is $Na_2CO_3$ providing $CaCO_3$ as the metal salt MA.

In some embodiments, M is calcium, Y is sodium, A is carbonate and X is chloride. In other words, MX is $CaCl_2$ and YA is $Na_2CO_3$ providing $CaCO_3$ as the metal salt MA.

In some embodiments, one of the solvents is an organic solvent, a mixture of organic solvents or a mixture of organic solvents and water, and the other one of the solvents is a mixture of organic solvents, a mixture of organic solvents and water or water. In some embodiments, the organic solvent(s) is (are) an alcohol(s). In some embodiments, the organic solvent is ethanol.

In some embodiments, the solvent of the metal salt solution is an organic solvent such as an ether (e. g. tetrahydrofuran, diethyl ether), an aldehyde, a ketone (e. g. acetone), an organosulfur compound (dimethyl sulfoxide), an amide (e. g. dimethylformamide), an amine, a cyclic or heterocyclic aromatic compound (e. g. benzene, pyridine).

In some embodiments, one of the solvents is an organic solvent and the other one of the solvents is water. In some embodiments, the organic solvent is an alcohol. In some embodiments, the organic solvent is ethanol.

In some embodiments, the solvent of the metal salt solution is an organic solvent, a mixture of organic solvents or a mixture of organic solvents and water, and the solvent of the salt solution is a mixture of organic solvents, a mixture of organic solvents and water or is water.

In some embodiments, the organic solvent the organic solvent(s) is (are) an alcohol(s). In some embodiments, the organic solvent is ethanol.

In some embodiments, the solvent of the metal salt solution is an organic solvent and the solvent of the salt solution is water. In some embodiments, the organic solvent is an alcohol. In some embodiments, the organic solvent is ethanol.

In some embodiments, one of the solvents is an alcohol, a mixture of alcohols or a mixture of alcohols and water, and the other one of the solvents is a mixture of alcohols and water or water. In some embodiments, one of the solvents is ethanol and the other one of the solvents is water.

In some embodiments, one of the solvents is an alcohol and the other one of the solvents is water. In some embodiments, one of the solvents is ethanol and the other one of the solvents is water.

In some embodiments, the solvent of the metal salt solution is an alcohol, a mixture of alcohols or a mixture of alcohols and water, and the solvent of the salt solution is a mixture of alcohols and water or water.

In some embodiments, the solvent of the metal salt solution is an alcohol and the solvent of the salt solution is water. In some embodiments, the solvent of the metal salt solution is ethanol and the solvent of the salt solution is water.

In some embodiments, the impregnation steps (first impregnation step and second impregnation step) are performed in an alternating order for several times.

Thus, a wood material is impregnated in a first impregnation step using one of said solutions (e.g. the metal salt solution). The first impregnation step is followed by a second impregnation step using the other one of said solutions (e.g. the salt solution), providing a metal salt of the formula MA inside the wood material. Therefore, the impregnation of the wood material according to the process of the invention comprises two subsequent impregnation steps (alternating impregnation). In other words, an impregnation cycle is achieved by a first impregnation step (using one of said solutions) followed by a subsequent second impregnation step (using the other one of said solutions). After the second impregnation step the impregnation cycle is finished and another impregnation cycle may follow comprising another impregnation step with the solution of the first impregnation step (e.g. the metal salt solution) and, subsequently a further impregnation step using the solution of the second impregnation step (e.g. the salt solution). This process (repetition of the alternating impregnation steps) may be performed for several further times.

In some embodiments, several impregnation steps with solutions comprising different educts (different salts MX and/or different salts YA) may be used. For example, in the first impregnation cycle the first impregnation step comprises a solution with a metal salt MX (e.g. $CaCl_2$) and the second impregnation step comprises a solution with a salt YA (e.g. $NaCO_3$). The subsequent second impregnation cycle comprises in the first impregnation step a solution with another metal salt MX (e.g. $BaCl_2$) and the second impregnation step comprises a solution with another salt YA (e.g. $NaSO_4$). The subsequent (optional) third impregnation cycle may comprise the same educts as the first impregnation cycle or other different (not used in the first and second cycle) educts. The same applies to optional further impregnation steps. The same applies further for mixtures of metal salts MX or salts YA in the applied solutions. It is further possible that only one of the educts is changed in each impregnation cycle. For example MX is the same, such as $CaCl_2$, and YA is varied in each cycle, e.g. $Na_2CO_3$ (first cycle) and $Na_2SO_4$ (second cycle). It is also possible to use only different metal salts (e.g. YA is the same, such as $Na_2CO_3$, and MX is varied in each cycle, e.g. $CaCl_2$ (first cycle) and $BaCl_2$ (second cycle)).

By multiple repetitions of the alternating impregnation steps (impregnation cycles) increased formation of the desired mineral inside the wood material is achieved. Furthermore, the use of different metal salts in different solvents ("selective solubility method"), as described above, allows solving the problem of the precipitation of salts at the wood surface. Given the possibility of combining different salts with suitable solvents it is possible to provide wood material with novel or improved properties.

In general, the properties of the desired product depend on the applied metal salt MA, the "amount" of the metal salt MA inside the mineralized wood material (the weight the metal salt MA with respect to the weight of the unmineralized wood, as discussed concerning the first aspect of the invention) and the range of the penetration of the metal salt MA in the mineralized wood material (penetration depth in regard of sample size (complete penetration) and the location of MA in cell lumina and/or cell wall). The amount of the metal salt and the range of penetration depend on the times of performed impregnation cycles, the used concentration of the educts in the first and second solution and the length of the impregnation steps. Depending on the chosen metal salt, the type and the size of the wood or wood based material and the desired properties a general user can choose - on basis of his general knowledge or simple experiments—the necessary impregnation cycles, concentration or length of the impregnation steps.

In some embodiments, the impregnation cycle is performed for 1 to 10 times, in particular for 1, 2, 3 or 4 times.

In some embodiments, the first and second impregnation step is performed equally or not equally for one minute up to several days.

In some embodiments, the first and second impregnation step is performed for 2 to 24 hours.

In some embodiments, the metal salt solution comprises a concentration of the metal salt MX in the range of 0.001 mol/l to saturation concentration, depending on selected M, X and solvent (see solubility values in literature). In particular the metal salt solution comprises a concentration of the metal salt MX in the range of 0.5 to 2.5 mol/l, more particularly 1 to 2 mol/l. The salt solution comprises a concentration of the salt YA in the range of 0.001 mol/l to saturation concentration, in particular 0.5 to 2.5 mol/l, more particularly 0.5 to 1.5 mol/l, depending on selected Y, A and solvent. The concentrations of the metal salt solution and the salt solution, may be used in equimolar concentrations of MX and YA or as an excess of MX over YA or as an excess of YA over MX, In some embodiments, a mixture of metal salts MX in equimolar or in different concentrations is used. In some embodiments, a mixture of metal salts YA in equimolar or in different concentrations is used.

In some embodiments, the first solution comprises 0.001 mol/l to saturation concentration, in particular 0.5 to 2.5 mol/l, more particularly 1 to 2 mol/l $CaCl_2$ dissolved in ethanol and the second solution comprises 0.001 mol/l to saturation concentration, in particular 0.5 to 2.5 mol/l more particularly 0.5 to 1.5 mol/l $Na_2CO_3$dissolved in water.

The salt solutions of MA and YA dissolved in the above-described solvents are impregnated in alternating impregnation steps to swell the wood cell walls in a diffusion-controlled process. Depending on the sample size, pressure or vacuum treatments are used to aid in-depth penetration [see Hill, C. A., Wood modification: chemical, thermal and other processes. Wiley Chichester].

In some embodiments, the wood material is a solid wood product, a wood-containing base material, a wood-based material, a semi-finished product or a component.

The process according to the second aspect of the invention allows for producing various mineralized wood products with different property profiles based on the chosen combinations of metal salts and their respective anions.

It further provides an environmentally friendly (since no hazardous chemicals are used) and cost-efficient industrial modification process for the fabrication of novel mineralized wood materials. The mineralization process of the invention considerably improves the reliability of wood in a cost-efficient processing step, without impairing the intrinsic key benefits of wood arising from its biological nature. One of the key flaws of wood materials is the flammability. The process of the invention allows for providing wood materials with a significantly increased flame retardancy. The process further allows for inserting different minerals (various cation and anion combinations)—in a cost effective and simple manner—to achieve different wood material improvements or the development of mineralized wood materials with novel functions.

Reference is made to the described properties of the first aspect of the invention.

The third aspect of the invention relates to a method for treatment of a wood material comprising the steps of:

a) provision of a solution comprising at least one metal salt of the formula MX dissolved in dimethyl carbonate or diethyl carbonate,
b) impregnation of wood with at least one impregnation step using said solution,
c) hydrolysis of the impregnated wood material with an aqueous solution, in particular with an aqueous solution comprising a pH range of more than 7, providing a metal carbonate.

The impregnation of wood in at least one impregnation step using said solution allows for a deep penetration of the metal part M of the used metal salt MX inside the wood. The metal part M is not only situated on (or near) the surface of the processed wood but "deep inside" of the wood material. The impregnation step may be applied for several times.

Subsequently, a hydrolysis, in particular a basic hydrolysis (a pH of more than 7) is applied on the impregnated wood material. Due to the conditions the solvent is decomposing providing gaseous $CO_2$, which reacts under these conditions with the cationic metal part of the metal salt MX and the respective metal carbonate starts to precipitate. Since the metal part M is distributed throughout different layers of the wood (deep penetration), the metal carbonate not only precipitates at (or near) the surface but also "deep inside" the processed wood (in the wood lumina and even in the cell walls). Furthermore, only water-soluble by-products are formed, such as methanol (in case dimethyl carbonate is used) or ethanol (in case diethyl carbonate is used), which do not interfere with the nucleation and growth of calcium carbonate.

Thus, the processed mineralized wood material according to the method of the invention comprises high fire retardency due to the precipitated salts MA "inside" the wood.

In some embodiments, said pH is in the range of 1-14.

In some embodiments, said pH is in the range of 8 to 10 for YA=$NaHCO_3$, but up to pH=12 for YA=$Na_2CO_3$. In some embodiments, said pH is below 6 for YA=$(NH_4)_2SO_4$. Extreme pH values (pH≤9, pH≥4) are known to impair the mechanical stability of wood.

In some embodiments, said pH is approximately 9.

In some embodiments, the metal part M of the metal salt MX is chosen in such a way that the provided metal carbonate has a solubility below 0.01 g per 100 mL in water. In other words, the metal M of the metal salt MX is chosen in such a way that the desired product (metal carbonate) comprises the above mentioned solubility (badly to nearly insoluble in water).

In some embodiments, M is selected from multivalent metals such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$.

In some embodiments, M is selected from earth alkali metals, in particular from magnesium, barium or calcium, more particularly from calcium.

In some embodiments, X is selected from bromide, iodide or chloride, in particular X is chloride.

In some embodiments, M is selected from multivalent metals such as $Ca^{2+}$, $Mg^{2+}$, $Ba^{2+}$, $Al^{3+}$, $Sr^{2+}$, $Fe^{2+}$, $Fe^{3+}$, $Zr^{2+}$, $Zn^{2+}$ or $Mn^{2+}$, in particular $Ca^{2+}$, $Ba^{2+}$, $Mg^{2+}$ or $Al^{3+}$, and X is selected from bromide, iodide or chloride, in particular X is chloride.

In some embodiments, M is selected from earth alkali metals, in particular from magnesium, barium or calcium, more particularly from calcium, and X is selected from bromide, iodide or chloride, in particular X is chloride.

In general, the properties of the desired product depend on the desired metal carbonate, the "amount" of the metal carbonate inside the wood material (the weight the metal carbonate M with respect to the weight of the unmineralized wood, as discussed concerning the first aspect of the invention) and the range of the penetration of the metal carbonate in the wood material (penetration depth in regard of sample size (complete penetration) and the location of MA in cell lumina and/or cell wall). The amount of the metal carbonate and the range of penetration depend on the performed impregnation times, the used concentration of the educt MX in the solution, the length of the impregnation step(s) and the applied pH range.

Depending on the chosen metal carbonate, the type of (and the size of) the wood material and the desired properties a general expert can choose—on basis of his general knowledge or simple experiments—the necessary impregnation cycles, concentration, pH range or length of the cycles.

In some embodiments, the impregnation step is performed for several times, in particular for 1, 2, 3 or 4 times.

In some embodiments, the impregnation step is performed for 2 to 24 hours.

In some embodiments, the metal salt solution comprises a concentration of the metal salt MX in the range of 0.1 to 5 mol/l, in particular 0.5 to 2.5 mol/l, more particularly 0.5 to 1.5 mol/l.

The process according to the third aspect of the invention provides a cost-efficient and simple industrial modification process for the fabrication of novel mineralized wood materials. The mineralization process of the invention considerably improves the reliability of wood by reducing the flammability, without impairing the intrinsic key benefits of wood arising from its biological nature. The flame retardancy is significantly improved.

The fourth aspect of the invention relates to a mineralized wood material comprising a metal salt of the formula MA in the lumina of the mineralized wood material, in particular in the lumina and the cell walls of the mineralized wood material obtained by a method according the second aspect of the invention or by a method according to the third aspect of the invention.

Concerning specific embodiment reference is made to the detailed description above.

The invention is further illustrated (without being limited by these examples or figures) by the following examples and figures.

SHORT DESCRIPTION OF THE FIGURES

Figure 1:
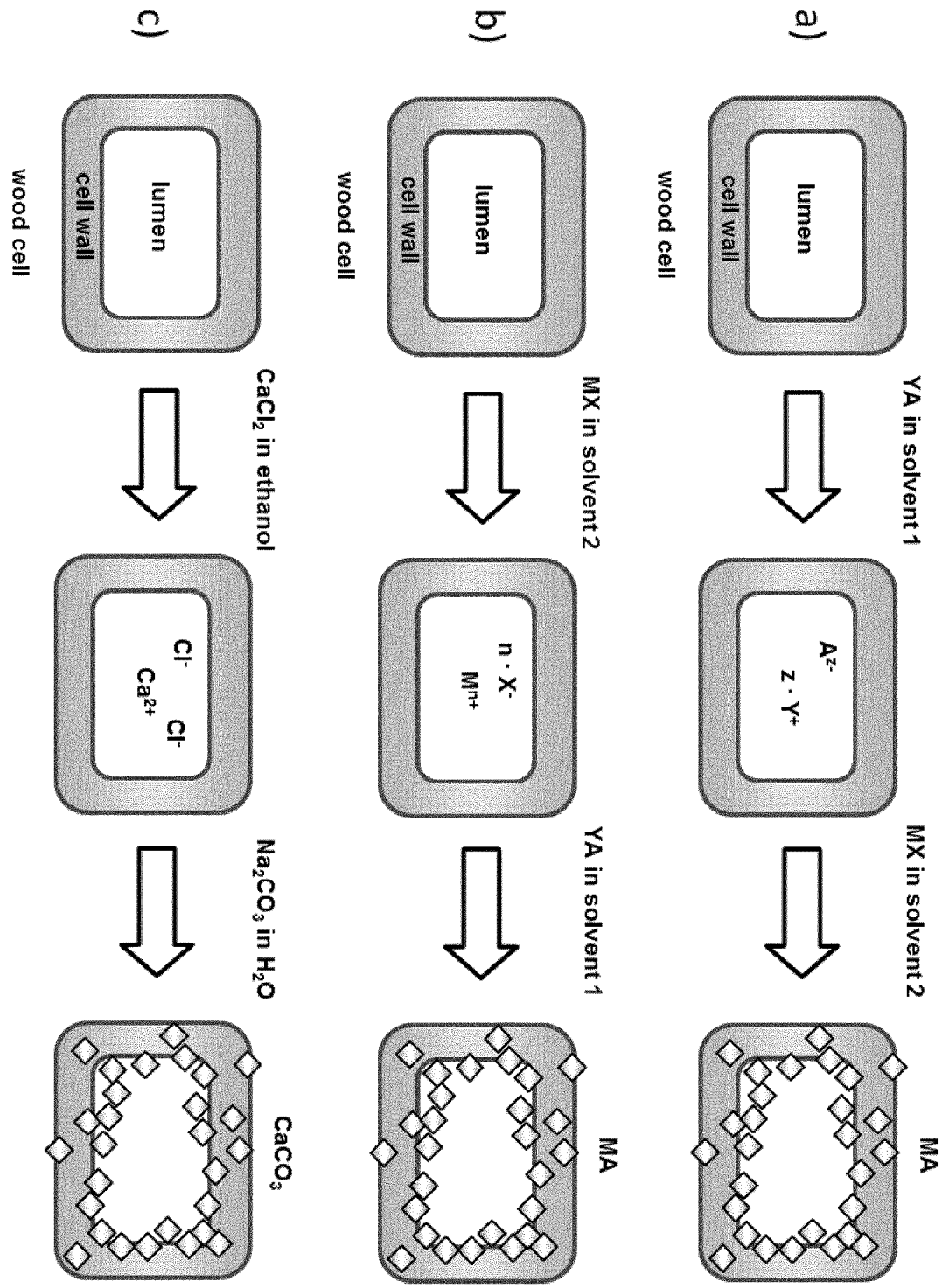
Figure 2:
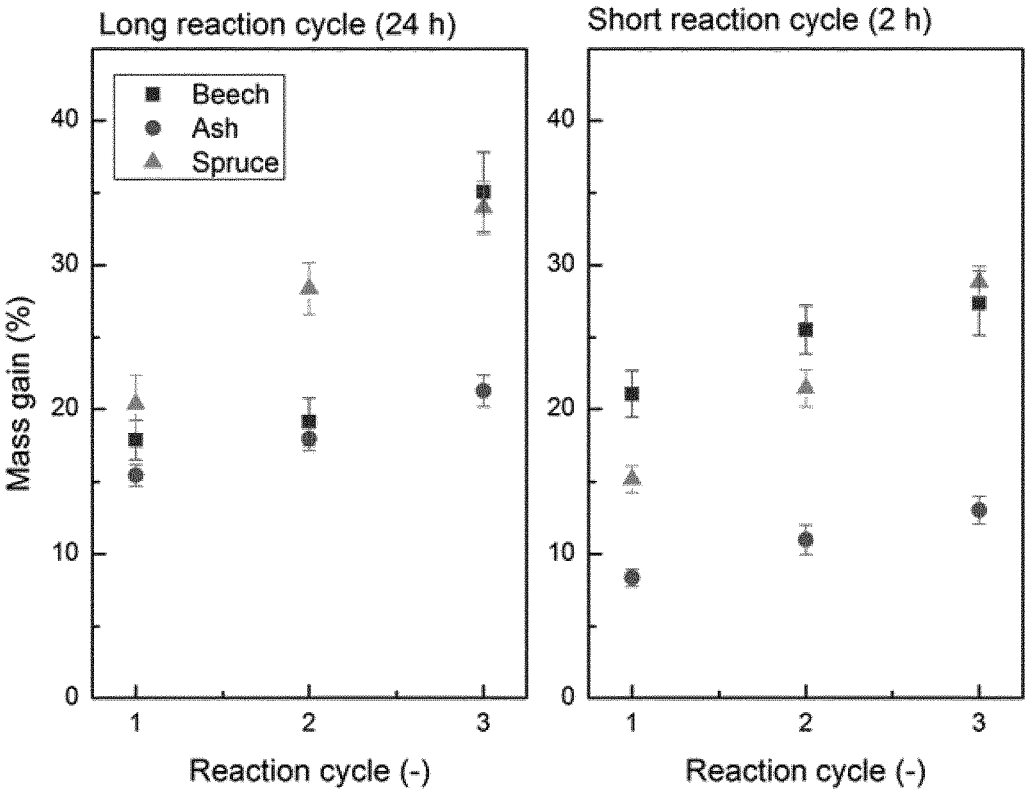
Figure 3:
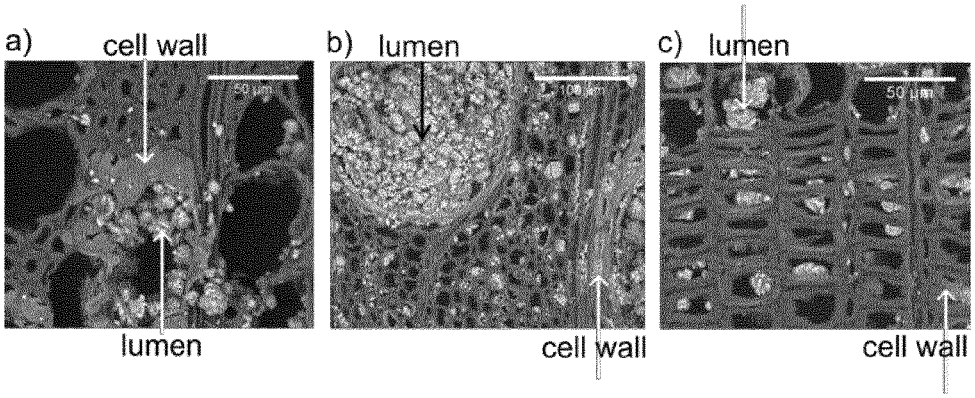
Figure 4:
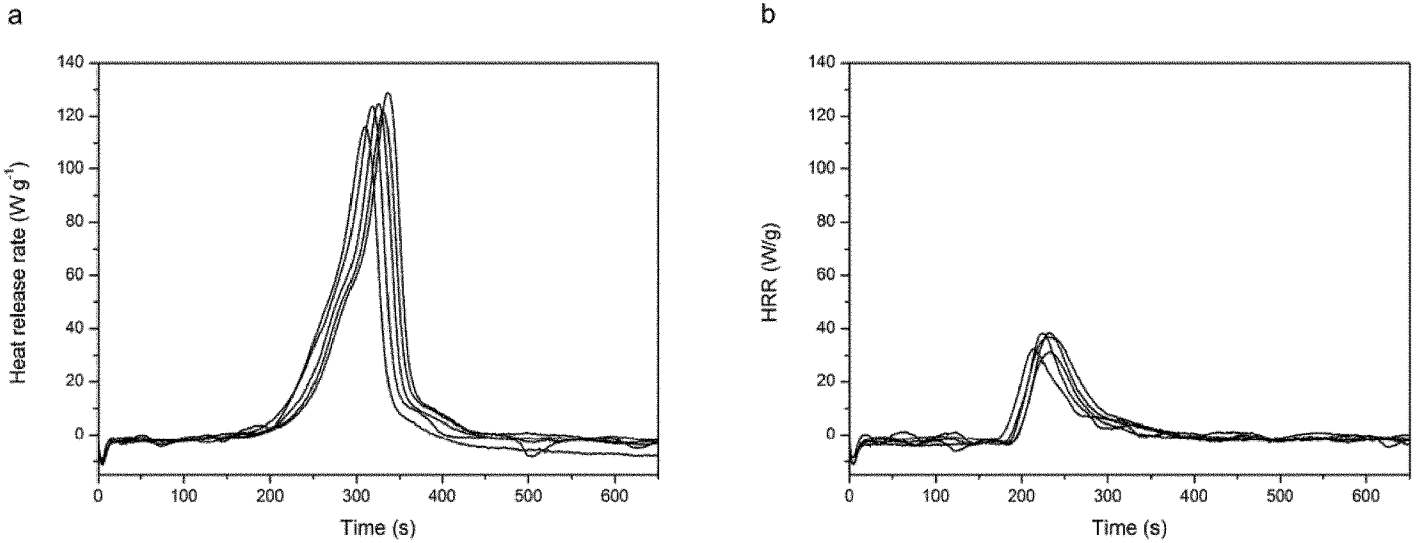
Figure 5:
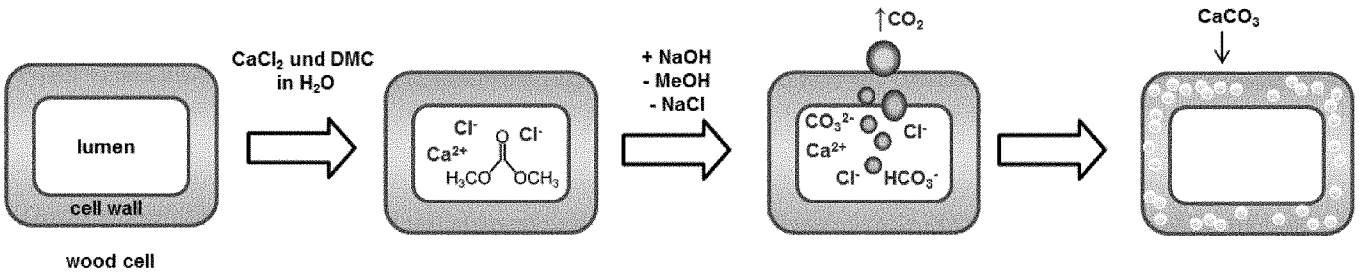
Figure 6:
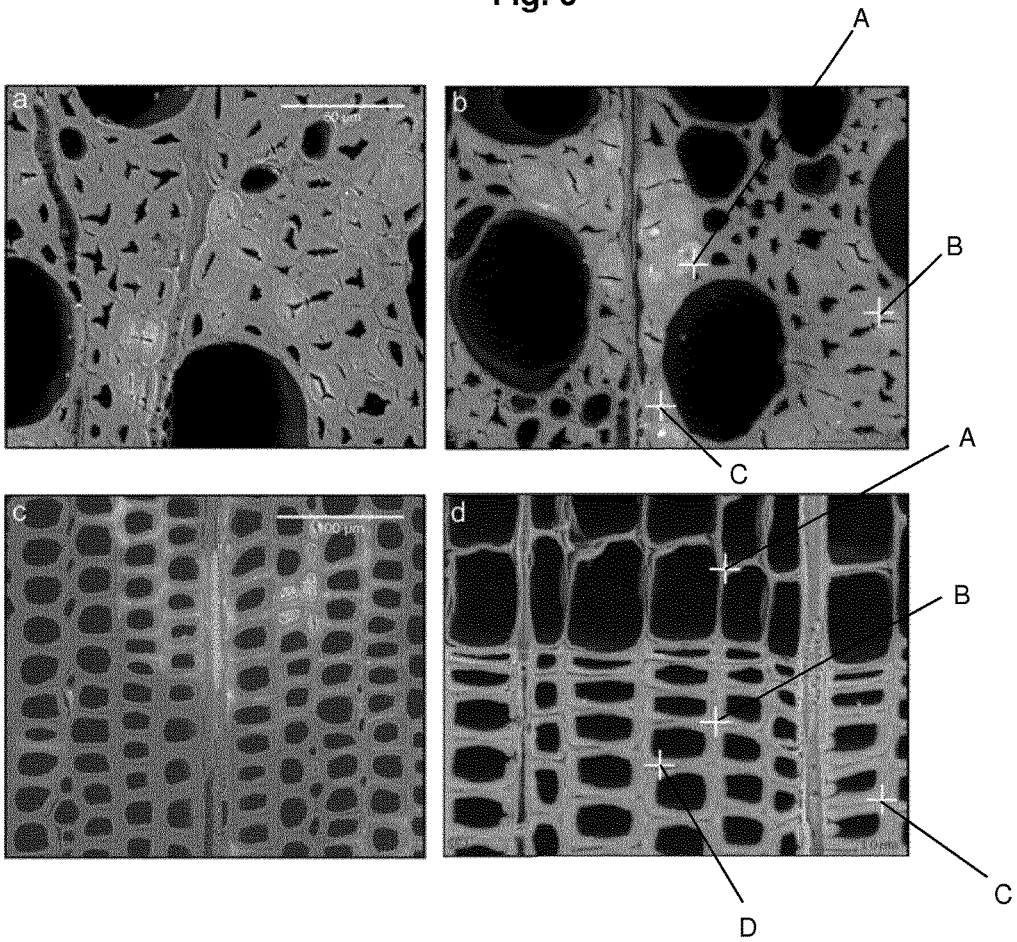
Figure 8:
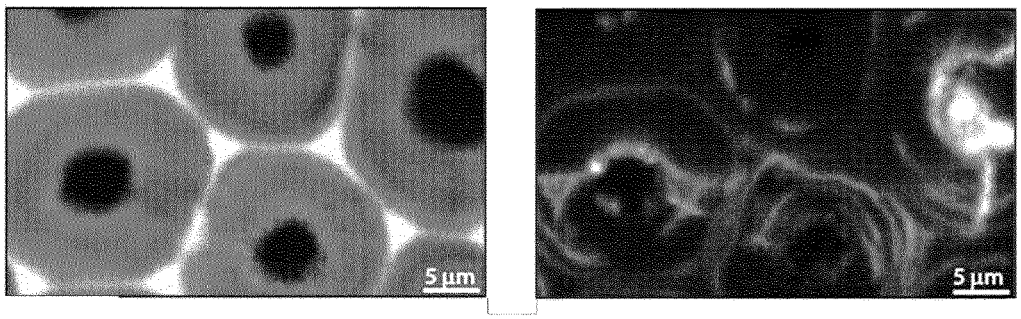

FIG. 1: shows a reaction scheme concerning the use of a salt solution YA in the first impregnation step (a), concerning the use of a metal salt solution MA in the first impregnation step (b) or concerning the use of calcium carbonate (c) with respect to the mineralization of wood in an alternating solvent system;

FIG. 2: shows the mass gain of spruce, beech and ash based on the number (1 to 3 times) and duration (1 hours or 24 hours) of the reaction cycles obtained by a method according to the third aspect of the invention;

FIG. 3: shows scanning electron microscopic images of mineralized (a) beech, (b) ash and (c) spruce (4 cycles each 24 hours) obtained by a method according to the third aspect of the invention, wherein lighter areas indicate the presence of calcium carbonate in cell lumina as well as partly in cell walls;

FIG. 4: shows (a) a time-dependent heat release rate of native spruce (b) a time-dependent heat release rate of spruce-calcium carbonate composite obtained by a method according to the third aspect of the invention with 4 cycles each for 24 hours;

FIG. 5: shows a reaction scheme of calcium carbonate mineralization of wood using a hydrolysis step;

FIG. 6: shows SEM images of mineralized wood samples in the backscattered electron mode of beech (a, b) and spruce (c, d) and EDX point analysis of CaK α-line at selected positions indicating a deposition within the wood cell wall (in FIG. 6*b* A indicates 8.84 Wt % (CaK), B indicates 6.68 Wt % (CaK) and C indicates 4.49 Wt % (CaK); in FIG. 6*d* A indicates 6.64 Wt % (CaK), B indicates 8.75 Wt % (CaK), C indicates 7.23 WT % (CaK) and D indicates 7.82 Wt % (CaK);

FIG. 7 shows temperature-dependent heat release rate of native spruce (unmodified spruce in a) and beech (unmodified beech in b) and wood/$CaCO_3$ composites, namely (c) comprising a composite of spruce/$CaCO_3$ (0.5 M DMC+0.5 M $CaCl_2$), (d) comprising a composite of beech/$CaCO_3$ (0.5 M DMC+0.5 M $CaCl_2$), (e) comprising a composite of spruce/$CaCO_3$ (1.0 M DMC+1.0 M $CaCl_2$), (f) comprising a composite of beech/$CaCO_3$ (1.0 M DMC+1.0 M $CaCl_2$), (g) comprising a composite of spruce/$CaCO_3$ (1.5 M DMC+1.5 M $CaCl_2$), (h) comprising a composite of beech/$CaCO_3$ (1.5 M DMC+1.5 M $CaCl_2$), (i) comprising a composite of spruce/$CaCO_3$ (prepared by 4 alternating impregnation cycles—2 h per cycle—beginning with 1.5 M $CaCl_2$ in ethanol followed by 1.0 M $Na_2CO_3$ in $H_2O$), (j) comprising a composite of beech/$CaCO_3$ (prepared by 4 alternating impregnation cycles—2 h per cycle—beginning with 1.5 M $CaCl_2$ in ethanol followed by 1.0 M $Na_2CO_3$ in $H_2O$, (k) comprising a composite of spruce/$CaCO_3$ (prepared by 4 alternating impregnation cycles—24 h per cycle—beginning with 1.5 M $CaCl_2$ in ethanol followed by 1.0 M $Na_2CO_3$ in $H_2O$) and (l) comprising a composite of beech/$CaCO_3$ (prepared by 4 alternating impregnation cycles—24 h per cycle—beginning with 1.5 M $CaCl_2$ in ethanol followed by 1.0 M $Na_2CO_3$ in $H_2O$;

FIG. 8: shows Raman mapping of $BaSO_4$/beech composites, (left side) shows the distribution of lignin emphasizing cell corners and middle lamella (aromatic ring stretching, 1554-1720cm$^{-1}$) (right side) shows the distribution of barium sulfate (958-1012 cm$^{-1}$) in beech fibers.

EXAMPLES AND INSTRUMENTS

ESEM-EDX. Environmental scanning electron microscopy (ESEM) in the low-vacuum mode was carried out on a FEI Quanta 200 3D coupled to an EDAX energy-dispersive X-ray spectrometer.

Pyrolysis combustion flow calorimetry. The heat of combustion of wood-calcium carbonate composites and reference wood was determined by oxygen consumption applied to the combustion gases in pyrolysis combustion flow calorimetry (PCFC) (Fire Testing Technology Instrument UK) with a pyrolysis temperature of 85-750° C. and a 80% $N_2$/20% $O_2$ gas mixture and operated at a heating rate of $\beta$=1 K s$^{-1}$ and a combustion temperature of 900° C. The PCFC measurements were replicated at least five times for samples of approximately 5 mg. The char yield was determined directly after combustion. The HRR curves were baseline-corrected and fitted with multiple Gauss curves using the program OriginPro 8.1. Herein, the resulting peak sum (the total heat release) displayed residual values close to 1. The maximum heat release divided by the constant heating rate $\beta$=1 K s$^{-1}$ gives the heat release capacity.

Examples According to the Second Aspect of the Invention a) Calcium Carbonate Mineralization of Wood in a Two-solvent Impregnation Cycle System Highly mineralized wood (beech, spruce, ash) has so far been obtained by vacuum-assisted impregnation of bulk wood (edge length of the samples up to 2 cm) in 1.5 mol/L $CaCl_2$ in ethanol and 1 M $Na_2CO_3$, in water in alternating reaction cycles (1-4 cycles) (FIG. 1). The wood pieces were placed in glass beakers and completely immersed in the reaction solution. Vacuum was applied at least three times to replace air within the wood tissue by the liquid. The reaction time was varied between 2 h to 24 h. The calcium carbonate mineralization of wood targets a significant improvement of fire retardancy without impairing mechanical strength of wood and wood-based products in practical applications.

b) Calcium Carbonate Mineralization of Wood in a Two-side Diffusion System

An unmineralized wood body is placed in a reaction chamber within water resistant gaskets, giving two separate compartments, which are leakage free. In each compartment, the salt solution and the metal salt solution are given, respectively, which are separated by the wood body. The gaskets must prevent leakage of the two solutions, so that the diffusion and precipitation can occur exclusively through and in the wood respectively. In some embodiments, the metal salt solution comprises a concentration of the metal salt MX in the range of 0.001 mol/l to saturation concentration, depending on selected M, X and solvent (see solubility values in literature). In particular the metal salt solution comprises a concentration of the metal salt MX in the range of 0.5 to 2.5 mol/l, more particularly 1 to 2 mol/l. The salt solution comprises a concentration of the salt YA in the range of 0.001 mol/l to saturation concentration, in particular 0.5 to 2.5 mol/l, more particularly 0.5 to 1.5 mol/l, depending on selected Y, A and solvent. The concentrations of the metal salt solution and the salt solution, may be used in equimolar concentrations of MX and YA or as an excess of MX over YA or as an excess of YA over MX. In some embodiments, a mixture of metal salts MX in equimolar or with different concentrations is used. In some embodiments, a mixture of metal salts YA in equimolar or in different concentrations is used. In particular, 1 mol/l $BaCl_2$ solution was placed in the reaction chamber on one side of the wood body and 1 mol/l $Na_2SO_4$ solution was placed on the other side of the wood body. The two solutions were let diffuse over time a certain time period (minimum 1 hour up to several weeks). The two solutions can be exchanged with fresh solutions in regular time intervals, depending on the desired mineralization degree. The final mineralized wood body comprises $BaSO_4$ as the MA mineral phase.

c) Characterization of Calcium Carbonate/Wood Composites Regarding Weight Percent Gain Using the process of the invention, high amounts of calcium carbonate can be incorporated into the wood structure tunable by varying the reaction conditions (number of reaction cycles, reaction time) for each type of wood (FIG. 2).

By using a short reaction cycle of 2 hours a mass gain of more than 5% (ash) up to more than 20% (beech) in only one cycle is achieved. By applying the alternating impregnation steps for 3 times the mass gain is in the range of more than 10% (ash) up to more than 25% (spruce or beech). The resulting mass uptake depends on the wood species, the sample geometry and other factors.

By using a long reaction cycle of 24 hours a mass gain of more than 15% (ash) up to more than 20% (spruce) in only one cycle is achieved. By applying the alternating impregnation steps for 3 times the mass gain is in the range of more than 20% (ash) up to nearly 35% (beech).

d) Mineralized Wood Material

Scanning electron microscopic images and Raman mapping indicate the incorporation of calcium carbonate inside the wood lumina and partially in the wood cell walls (FIG. 3 and FIG. 8).

e) Reduced Flammability of Wood-calcium Carbonate Composites

The heat of combustion of spruce-calcium carbonate composites was determined by oxygen consumption in a pyrolysis combustion flow calorimetry (PCFC) probe. The peak heat released per unit mass and per degree of temperature assessing the specific flammability of the material was reduced from 123±5 J g$^{-1}$ K$^{-1}$ in native spruce to 38±4 J g−1 K−1 (−30% remaining) in the inorganic hybrid wood composite. This parameter reveals the tendency to ignite objects nearby and to maintain flame combustion. The net heat of complete combustion is also decreased to 2.6±0.4 kJ g$^{-1}$ (−31%) compared to unmodified spruce (6.0±0.5 kJ g$^{-1}$). The char yield of the modified spruce is considerably higher than for native wood (38±2% compared to 16±1%) (FIG. 4).

A summary of the total heat release, the heat release capacity and the char yield for examples of mineralized wood materials is shown in table 2.

TABLE 2

Pyrolysis combustion flow calorimetry data of wood (spruce, beech) and $CaCO_3$/wood composites prepared with 4 alternating cycles (2 h or 24 h per cycle) of 1.5M $CaCl_2$ and 1M $Na_2CO_3$.

| Reaction | Total heat released [kJ $g^{-1}$] | | Heat release capacity [J $g^{-1}$ $K^{-1}$] | | Char yield [%] | |
|---|---|---|---|---|---|---|
| conditions | Spruce | Beech | Spruce | Beech | Spruce | Beech |
| 0 | 8.0 ± 0.5 | 8.1 ± 0.2 | 123 ± 5 | 114 ± 5 | 15.5 ± 0.8 | 17.0 ± 1.6 |
| 4 cycles (2 h/cycle) | 3.0 ± 0.6 (38%) | 3.4 ± 0.6 (42%) | 49 ± 9 (40%) | 34 ± 2 (30%) | 35.1 ± 3.1 (226%) | 33.9 ± 2.9 (199%) |
| 4 cycles (24 h/cycle) | 2.6 ± 0.4 (33%) | 2.9 ± 0.5 (36%) | 38 ± 4 (31%) | 35 ± 3 (31%) | 38.2 ± 2.4 (246%) | 35.9 ± 1.2 (211%) |

Examples According to the Third Aspect of the Invention a) Calcium Carbonate Mineralization of Wood in a One-solvent System Blocks of spruce and beech wood (20 mm edge length) were immersed in an equimolar solution of $CaCl_2$ and dimethyl carbonate (0.5 mol $L^{-1}$, 1.0 mol $L^{-1}$, 1.5 mol $L^{-1}$) under continuously stirring and vacuum-impregnated for several times. The controlled hydrolysis was initiated by adding an aqueous sodium hydroxide solution (e. g. concentration=1 mol $L^{-1}$) to the reaction solution. In this process only water-soluble by-products are formed, such as methanol (dimethyl carbonate), which do not interfere with the nucleation and growth of calcium carbonate (FIG. 5).

b) Mineralized Wood Material

SEM images of mineralized wood samples indicate the incorporation of calcium carbonate inside the wood lumina and partially in the wood cell walls (FIG. 6).

c) Reduced Flammability of wood-calcium Carbonate Composites

A summary of the total heat release, the heat release capacity and the char yield for examples of mineralized wood materials is shown in table 3.

TABLE 3

Pyrolysis combustion flow calorimetry data of wood (spruce, beech) and $CaCO_3$/wood composites prepared by alkaline hydrolysis of dimethyl carbonate in the presence of $CaCl_2$.

| c (DMC) | Total heat released [kJ $g^{-1}$] | | Heat release capacity [J $g^{-1}$ $K^{-1}$] | | Char yield [%] | |
|---|---|---|---|---|---|---|
| [mol $L^{-1}$] | Spruce | Beech | Spruce | Beech | Spruce | Beech |
| 0 | 8.0 ± 0.5 | 8.1 ± 0.2 | 123 ± 5 | 114 ± 5 | 15.5 ± 0.8 | 17.0 ± 1.6 |
| 0.5 | 4.2 ± 0.5 (52%) | 4.4 ± 0.4 (53%) | 57 ± 3 (46%) | 38 ± 2 (46%) | 29.9 ± 2.1 (193%) | 27.6 ± 1.4 (162%) |
| 1 | 2.9 ± 0.4 (37%) | 3.9 ± 0.2 (48%) | 52 ± 4 (42%) | 38 ± 3 (42%) | 33.1 ± 2.0 (214%) | 31.9 ± 2.5 (187%) |
| 1.5 | 2.5 ± 0.2 (32%) | 3.1 ± 0.4 (38%) | 45 ± 5 (37%) | 37 ± 5 (37%) | 37.7 ± 1.7 (243%) | 33.7 ± 1.3 (198%) |

The invention claimed is:

1. A mineralized wood material comprising at least one metal salt of the formula MA in the lumina of the mineralized wood material, in particular in the lumina and the cell walls of the mineralized wood material, wherein the at least one metal salt MA comprises a weight in the range of 5 wt % to 40 wt % with respect to the weight of the unmineralized wood material and A is selected from inorganic compounds.

2. The mineralized wood material according to claim 1, wherein

M is selected from multivalent metals, in particular from earth alkali metals, more particularly from magnesium, barium or calcium and A is selected from inorganic compounds, more particularly from sulfate, carbonate, borate, fluoride or phosphate.

3. A method for treatment of a wood material comprising the steps of:

a) provision of a metal salt solution comprising at least one metal salt of the formula MX dissolved in a solvent and a salt solution comprising at least one salt of the formula YA dissolved in another solvent, b) treatment of said wood material by an impregnation cycle comprising a first impregnation step using one of said solutions and a subsequent second impregnation step using the other one of said solutions, or a diffusion step comprising a diffusion of the metal salt solution from one side and a diffusion of the salt solution from the other side into the wood material, and c) providing a precipitation of a metal salt of the formula MA inside the wood material yielding a mineralized wood material, wherein the weight of said metal salt MA of said mineralized wood material is between 5 wt % and 40 wt % in relation to the weight of the unmineralized wood material, and the solvents of the metal salt solution and the salt solution are characterized in that the metal salt MA has a low or almost no solubility in said solvents, in particular the metal salt MA has a solubility below 0.01 g per 100 mL in said solvents and A is selected from inorganic compounds.

4. The method for treatment of wood according to claim 3, wherein in said first impregnation step said metal salt solution is used and in said subsequent second impregnation step said salt solution is used, providing a metal salt of the formula MA.

5. The method according to claim 3, wherein one of the solvents, in particular the solvent of the metal salt solution, is an organic solvent and the other one of the solvents is water, in particular the solvent of the salt solution is water.

6. A method for treatment of a wood material comprising the steps of:

a) provision of a solution comprising at least one metal salt of the formula MX dissolved in dimethyl carbonate or diethyl carbonate, b) impregnation of wood with at least one impregnation step using said solution, c) hydrolysis of the impregnated wood with an aqueous solution, in particular with an aqueous solution comprising a pH range of more than 7, providing a metal carbonate.

7. The method according to claim 3, wherein M is selected from multivalent metals, in particular from earth alkali metals, more particularly from magnesium, barium or calcium.

8. The method according to claim 3, wherein A is selected from sulfate, carbonate, borate, fluoride or phosphate.

9. The method according to claim 3, wherein Y is selected from monovalent compounds, in particular from alkali metals, more particularly from sodium or potassium.

10. The method according to claim 3, wherein X is selected from nitrate, bromide, iodide or chloride, in particular from bromide, iodide or chloride, more particularly X is chloride.

11. The method for treatment of wood according to claim 6, wherein the pH is in the range of 8.5 to 9.5, in particular said pH is approximately 9.

12. The method according to claim 3, wherein the impregnation of step is performed for 2 to 24 hours and/or the impregnation cycle is performed for several times, in particular for 1, 2, 3 or 4 times.

13. The method according to claim 3, wherein the concentration of the metal salt MX in the metal salt solution is in the range of 0.1 to 5 mol/l, in particular 0.5 to 2.5 mol/l, more particularly 1 to 2 mol/l, and the concentration of the salt YA in the salt solution is in the range of 0.1 to 5 mol/l, in particular 0.5 to 2.5 mol/l, more particularly 0.5 to 1.5 mol/l.

14. The method according to claim 6, wherein the solution comprises a concentration of the metal salt MX in the range of 0.1 to 5 mol/l, in particular 0.5 to 2.5 mol/l, more particularly 0.5 to 1.5 mol/l.

* * * * *